US008915524B2

(12) United States Patent
Charnesky et al.

(10) Patent No.: US 8,915,524 B2
(45) Date of Patent: Dec. 23, 2014

(54) VEHICLE DOOR AUXILIARY LATCH RELEASE

(75) Inventors: Scott P. Charnesky, Birmingham, MI (US); Robert D. Granny, Rochester Hills, MI (US); Jeffrey D. Rodgers, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 2221 days.

(21) Appl. No.: 11/683,474

(22) Filed: Mar. 8, 2007

(65) Prior Publication Data

US 2008/0217955 A1 Sep. 11, 2008

(51) Int. Cl.

| | |
|---|---|
| ***E05C 3/00*** | (2006.01) |
| ***E05B 79/20*** | (2014.01) |
| *E05C 3/16* | (2006.01) |
| *E05B 81/90* | (2014.01) |
| *E05B 85/04* | (2014.01) |

(52) U.S. Cl.

CPC ..... *E05B 79/20* (2013.01); *E05B 81/90* (2013.01); *E05B 85/045* (2013.01)

USPC ..... 292/216; 292/336.3

(58) Field of Classification Search

USPC ..... 292/201, 216, 336.3

See application file for complete search history.

(56) References Cited

U.S. PATENT DOCUMENTS

| | | | | |
|---|---|---|---|---|
| 3,400,961 | A * | 9/1968 | Koch et al. | 292/216 |
| 3,858,922 | A * | 1/1975 | Yamanaka | 292/336.3 |
| 4,917,418 | A * | 4/1990 | Gokee | 292/125 |
| 4,974,885 | A * | 12/1990 | Yokoyama | 292/201 |
| 4,998,758 | A * | 3/1991 | Kowalczyk et al. | 292/201 |
| 5,222,774 | A * | 6/1993 | Fukumoto et al. | 292/144 |
| 5,535,608 | A * | 7/1996 | Brin | 70/256 |
| 5,662,369 | A * | 9/1997 | Tsuge | 296/66 |
| 5,927,794 | A * | 7/1999 | Mobius et al. | 296/146.1 |
| 6,017,067 | A * | 1/2000 | Yoneyama et al. | 292/216 |
| 6,854,870 | B2 * | 2/2005 | Huizenga | 362/501 |
| 6,883,840 | B2 * | 4/2005 | Sueyoshi et al. | 292/336.3 |
| 2006/0076788 | A1 * | 4/2006 | Gotou et al. | 292/336.3 |

FOREIGN PATENT DOCUMENTS

| | | |
|---|---|---|
| DE | 4033532 A1 | 4/1992 |
| DE | 4425423 C1 | 8/1995 |
| DE | 19809415 A1 | 9/1999 |

* cited by examiner

*Primary Examiner* — Carlos Lugo

(57) ABSTRACT

An auxiliary latch release assembly, and method of operation, for use with a vehicle having a body defining a cargo area, a door, and a door latch mounted in the door and including an auxiliary latch release. The assembly may comprise a handle that is accessible in the cargo area, a release cable having a first end engaging the handle and a second end extending in the body adjacent to the door having the door latch, and an e-latch override assembly mounted in the body that engages the second end of the release cable and includes a latch release member. The latch release member can be actuated by the e-latch override assembly to engage the auxiliary latch release to release the door latch.

18 Claims, 5 Drawing Sheets

VEHICLE DOOR AUXILIARY LATCH RELEASE

BACKGROUND OF THE INVENTION

The present application relates generally to a vehicle door having an electronic latch release system for a door latch, and in particular to such a system also having an auxiliary latch release assembly.

There are some automotive vehicles that, for aesthetic and other reasons, have doors without outside door handles. They may have for example electronic touchpads mounted underneath the outer surface of the door, with touchpad access depressions in an adjacent body side outer panel. For these types of doors, then, an electronic door latch releases the door and allows it to open, rather than a traditional mechanical linkage from an outside door handle to the door latch. Since there is no outside door handle, and electric power is required to release the door latch, mechanically operated backups are employed to allow for door latch release should the electronic door latch malfunction or vehicle electrical power be lost.

If the electronic door latch is mounted in the vehicle body, then the door latch is stationary relative to the body. Accordingly, the mechanical overrides can be directly and continuously connected to the latch and provide a release handle accessible from some accessible location in the vehicle (e.g., a trunk). And no outside door handle or key cylinder is needed to accomplish this.

If, on the other hand, the electronic door latch is mounted in the door, for example the front door of a sedan, then the door latch moves out away from the body as the door is opened. One proposed method to allow for a mechanical backup in this situation is to add a key cylinder to the outside of the door, even though there is no handle. Then, if the electronic door latch is not operative, the key cylinder can be connected to the door latch to act as a backup mechanical release. But this solution somewhat defeats the original purpose for having no outside door handle. Another proposed method is to run a cable from the body, through the hinge pillar electrical conduit connected to the vehicle A-pillar, and through the interior of the door from front to back, making a direct and continuous connection to the electronic door latch. A release handle, then, may be located at some accessible location in the vehicle. But this option has proven to be less than ideal since the release cable moves with the door and must not only be routed through the hinge pillar with the electrical wires, but must also be routed around all of the electrical and mechanical assemblies inside the door.

Thus, a backup mechanical release for a vehicle door, having an electronic door latch mounted in it, is desired that overcomes the drawbacks of the prior art.

SUMMARY OF THE INVENTION

An embodiment contemplates an auxiliary latch release assembly for use with a vehicle having a body defining a cargo area, a door, and a door latch mounted in the door and include an auxiliary latch release. The assembly may comprise a handle adapted to be accessible in the cargo area, a release cable having a first end operatively engaging the handle and an opposed second end extending in the body adjacent to the door having the door latch, and an e-latch override assembly adapted to be in the body and operatively engaging the second end of the release cable and including a latch release member actuable by the e-latch override assembly to engage the auxiliary latch release to thereby release the door latch.

An embodiment contemplates a vehicle having a door mounted on a body and a cargo area, where the vehicle may have an electronic door latch mounted in the door and including an auxiliary latch release and an electronic latch releaser. The vehicle may also have an auxiliary latch release assembly including a handle accessible in the cargo area, a release cable having a first end operatively engaging the handle and an opposed second end extending adjacent to the door having the electronic door latch, and an e-latch override assembly mounted in the body and operatively engaging the second end of the release cable and including a latch release member actuable by the e-latch override assembly to engage the auxiliary latch release to thereby release the electronic door latch.

An embodiment contemplates a method of releasing an electronic door latch mounted in a door of a vehicle having a body, with the electronic door latch including an auxiliary latch release, the method comprising the steps of: manually actuating a release cable from a cargo area of the vehicle, wherein the release cable extends in the body adjacent to the door having the electronic door latch; actuating an e-latch override assembly, mounted in the body, with the release cable; bridging a gap between the door and the body with a latch release member of the e-latch override assembly that contacts the auxiliary latch release; and releasing the electronic door latch by moving the auxiliary latch release with the latch release member.

An advantage of an embodiment is that an auxiliary latch release assembly is provided for a vehicle door having an electronic door latch, without requiring an outside door handle or key cylinder.

An advantage of an embodiment is that the auxiliary latch release assembly operates to release the latch without requiring anything to be run through the hinge pillar electrical conduit or routed through the door interior. The auxiliary latch release assembly bridges the gap between the body and the door with a mechanical device to unlatch the door mounted latch, but does not interfere with the normal operation of the electronic door latch when auxiliary release is not needed.

DETAILED DESCRIPTION

Figure 1:
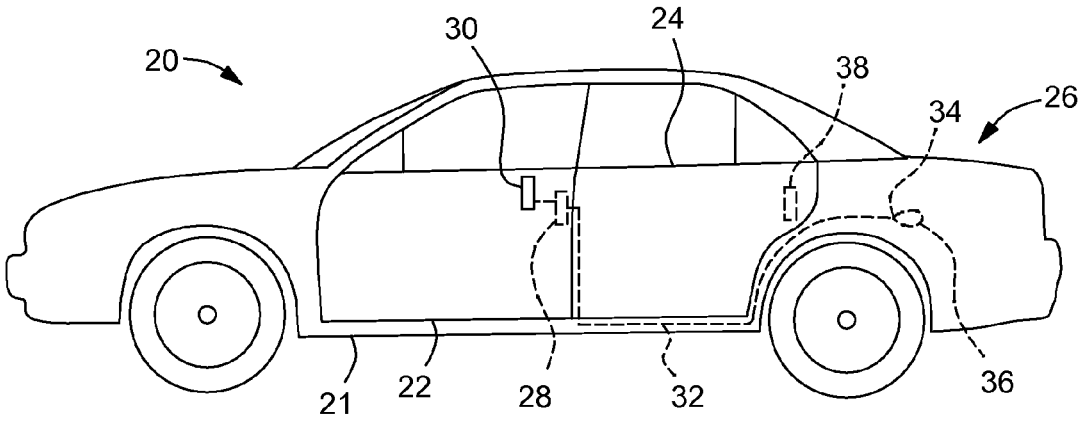
FIG. 1 is a schematic side view of a vehicle having an electronic door latch and auxiliary latch release assembly.

FIG. 1 illustrates a vehicle, indicated generally at 20, having a body 21 to which a front door 22 and a rear door 24 are mounted. The body 21 also includes a rear cargo area, such as a trunk, indicated generally at 26. An electronic door latch 28 is mounted in the front door 22 and is connected to an electronic latch control, such as an electronic touchpad 30 mounted to the front door 22. The details of the electronic door latch 28 and touchpad 30 will not be discussed in more detail herein since they are known to those skilled in the art. A release cable 32 is shown extending between a first end 34 connected to a release handle 36 in the trunk 26 and a second end 40 located in the body 21 near the door latch 28.

The rear door 24, of course, may also include an electronic door latch 38. In that instance, then, the release cable 32 may be routed to the rear door 24 instead of the front door 22, if so desired. Also, the vehicle 20 may be a two door vehicle instead of a four door, if so desired.

Figure 2:
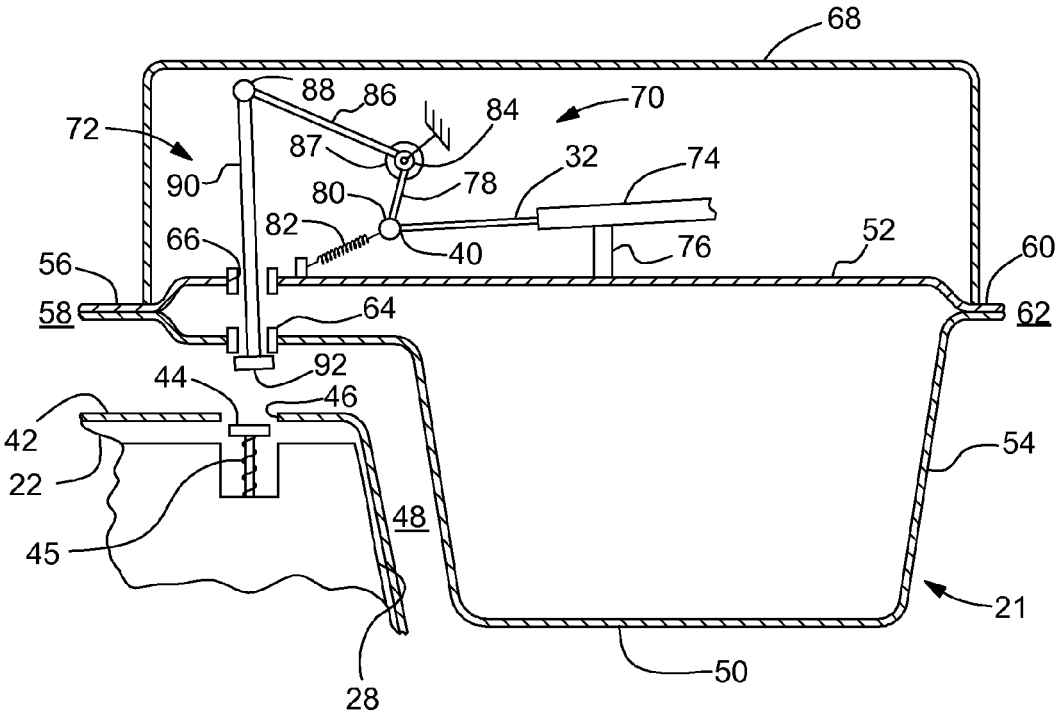
FIG. 2 is a schematic, plan view, section cut of a portion of an electronic door latch and an auxiliary latch release assembly according to a first embodiment.
Figure 3:
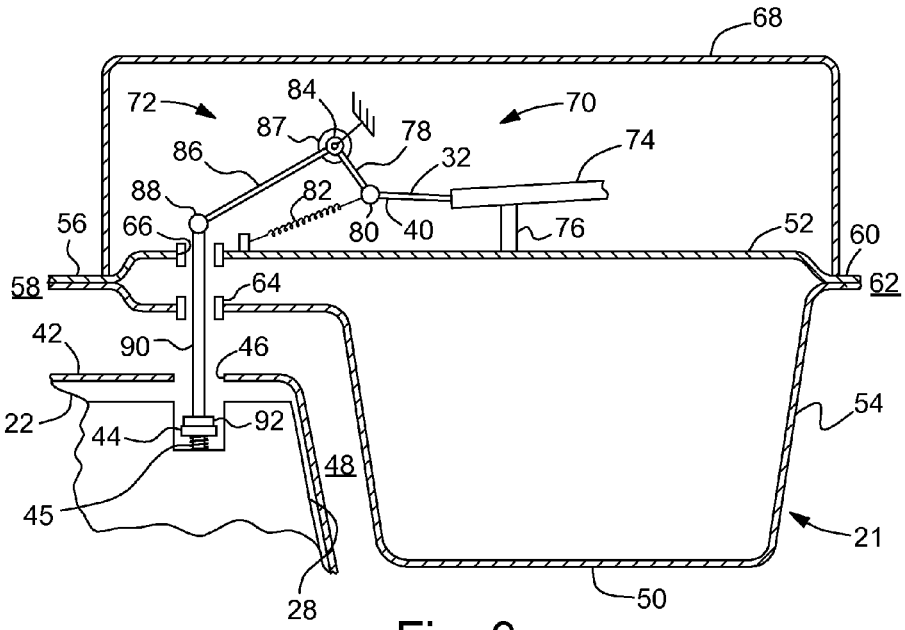
FIG. 3 is a schematic view similar to FIG. 2, but illustrating a latch release position for the auxiliary latch release assembly.

FIGS. 2 and 3, in conjunction with FIG. 1, illustrate a first embodiment. The front door 22 is shown having the door latch 28 mounted inside of a front door inner panel 42. An auxiliary latch release 44 extends from the door latch 28, adjacent to a latch release hole 46 in the inner panel 42. A latch release return spring 45 biases the auxiliary latch release 44 toward the latch release hole 46. The latch release hole 46 opens facing a gap, indicated generally at 48, between the front door 22 and the vehicle body 21.

The body 21 may include a body side outer panel 50 connected to a body side inner panel 52 to form a B-pillar 54, a front door flange 56 defining a front door opening 58, and a rear door flange 60 defining a rear door opening 62. Guide pads 64 may be mounted in latch release holes 66 extending through the body panels 50, 52. Interior trim 68 may be mounted to the body side inner panel 52 in order to conceal an auxiliary latch release assembly 70.

The auxiliary latch release assembly 70 includes an e-latch override assembly 72 that connects to the second end 40 of the release cable 32. The release cable 32 may have a cable sleeve 74 surrounding it that is mounted to the body 21 by a sleeve mount 76. The e-latch override assembly 72 may have a first pivot arm 78 that includes a pivotable cable attachment 80 engaging the second end 40 of the release cable 32. A return spring 82 connects between the pivotable cable attachment 80 and the body 21. The other end of the first pivot arm 78 is connected to a fixed pivot joint 84. The fixed pivot joint 84 is axially fixed but can rotate relative to the body 21. A second pivot arm 86 of the override assembly 72 is also connected to the fixed pivot joint 84 such that the angle between the first pivot arm 78 and the second pivot arm 86 is fixed—effectively creating a single rigid body 87. The other end of the second pivot arm 86 connects to a pivotable push arm attachment 88, which, in turn, connects to a push arm 90. The push arm 90 slides through and is guided by the guide pads 64. A latch release member 92 mounts on the end of the push arm 90 and is aligned to extend across the gap 48 and contact the auxiliary latch release 44 in the front door 22.

The operation of the auxiliary latch release assembly 70 will now be discussed. If, for whatever reason, the electronic door latch 28 will not release as desired, one may open the trunk 26 (or cargo area as the case may be), and pull on the release handle 36. Prior to pulling the release handle 36, the e-latch override assembly 72 will be in its closed (nominal) position, as seen in FIG. 2. In this closed position, the latch release member 92 on the push arm 90 is retracted toward the guide pads 64—basically out of the gap 48 between the front door 22 and body 21. This assures that there is no inadvertent contact between the latch release member 92 and the auxiliary latch release 44 of the door latch 28.

Upon pulling the release handle 36, the second end 40 of the release cable 32 will be pulled toward the cable sleeve 74 against the bias of the return spring 82. This will cause the pivotable cable attachment 80 to pivot the rigid body 87 about the fixed pivot joint 84. The pivot arms 78, 86 can be sized to not only change the direction of motion, but also to provide a mechanical advantage. This pivoting, in turn, will cause the rigid body 87 to slide the push arm 90 through the guide pads 64 and into the gap 48 toward the auxiliary latch release 44. Continued pulling on the release handle 36 causes the push arm 90 to contact and push the auxiliary latch release 44 into the door latch 28, thus triggering a release of the door latch 28 as the override assembly 72 reaches its latch release position (shown in FIG. 2). The front door 22 is now unlatched. Upon release of the release handle 36, the return spring 82 will move the auxiliary latch release assembly 70 back to its closed (nominal) position. One may then open the unlatched front door 22.

Figure 4:
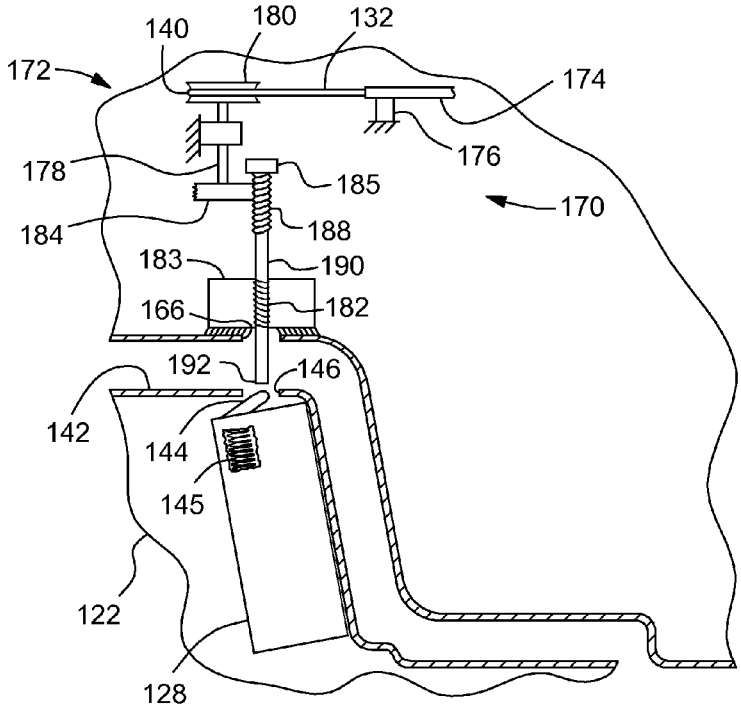
FIG. 4 is a schematic, plan view, section cut of a portion of an electronic door latch and an auxiliary latch release assembly according to a second embodiment.

FIG. 4 illustrates a second embodiment. This embodiment has many elements in common with that of the first embodiment, and to avoid unnecessary repetition of the description, the same reference numerals have been used for similar elements but falling within the 100-series. This embodiment employs a different type of e-latch override assembly 172 for the auxiliary latch release assembly 170, and a different auxiliary latch release 144.

The electronic door latch 128 mounts inside the front door 122, with a latch release hole 146 in the front door inner panel 142 adjacent to the auxiliary latch release 144. A latch release return spring 145 biases a free end of the auxiliary latch release 144 toward the latch release hole 146. The auxiliary latch release 144 in this embodiment is shown as a pivoting member instead of a linearly translating member as was the case in the first embodiment. However, either type of auxiliary latch release movement may be employed with either of these embodiments.

The auxiliary latch release assembly 170 still includes a release cable 132 in a cable sleeve 174 fixed by a sleeve mount 176, and the e-latch override assembly 172. The override assembly 172 includes a pulley 180 connected to the second end 140 of the release cable 132. A gear 184 is connected to the pulley 180 via a pulley shaft 178 and is rotated by the pulley 180. The gear 184 engages gear teeth 188 on a gear shaft 190, which extends out through a latch release hole 166 and defines a latch release member 192. The gear shaft 190 also includes a gear stop 185. A return spring 182 is mounted in a return spring housing 183 and engages the gear shaft 190 to bias the gear shaft 190 away from the auxiliary latch release 144.

The operation of the auxiliary latch release assembly 170 will now be discussed. Upon pulling the release handle (not shown in this view), the release cable 132 will cause the pulley 180 to rotate, which will cause the pulley shaft 178 to rotate the gear 184. The gear 184 will interact with the gear teeth 188, causing the gear shaft 190 to rotate. As it rotates, the gear teeth 188 will cause the gear shaft 190 to also axially translate toward the auxiliary latch release 144 against the bias of the return spring 182. The latch release member 192 will contact and pivot the auxiliary latch release 144 against the bias of the latch release return spring 145, thus triggering a release of the door latch 128. As the gear shaft 190 reaches its maximum desired extent of axial translation, the gear 184 will abut the gear stop 185, preventing any further travel. Upon release of the release handle, the return spring 182 will move the auxiliary latch release assembly 170 back to its closed (nominal) position. One may then open the unlatched front door 122.

Figure 5:
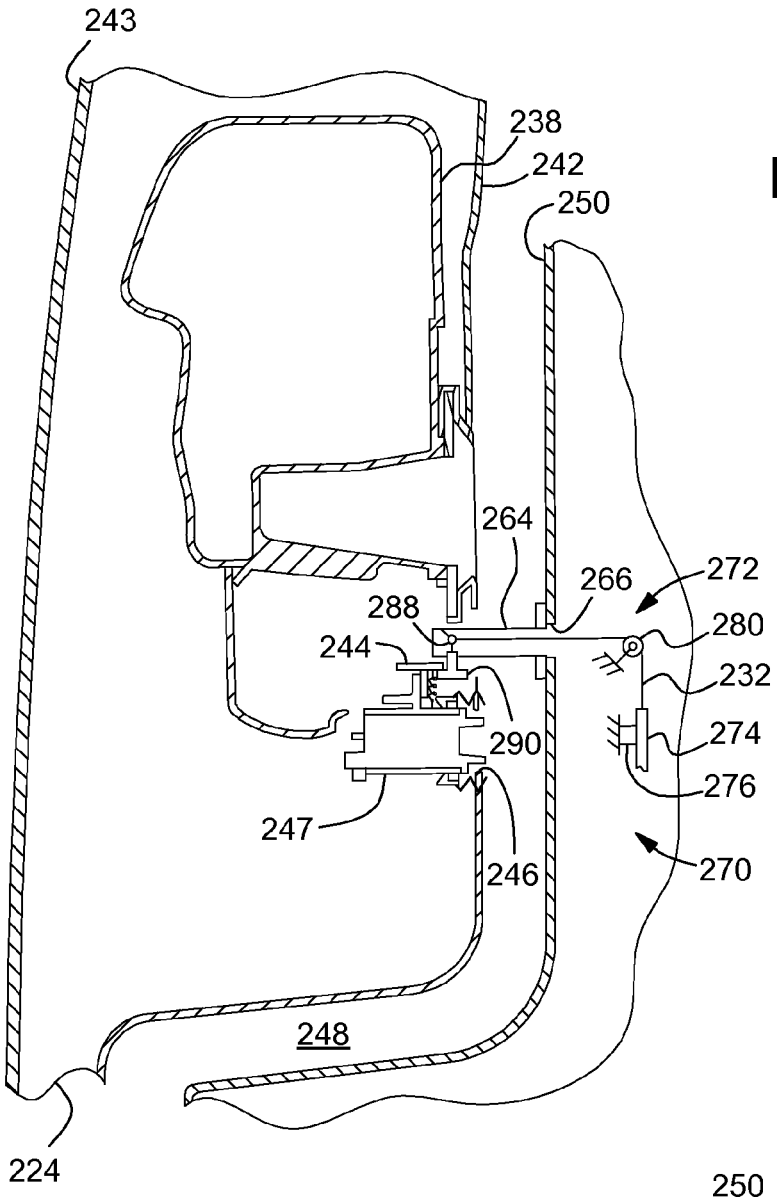
FIG. 5 is a schematic, elevation, section cut of a portion of an electronic door latch and an auxiliary latch release assembly according to a third embodiment.
Figure 6:
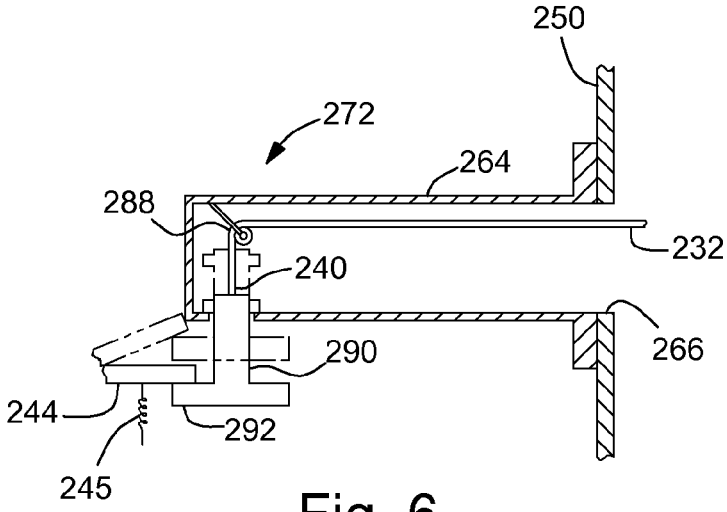
FIG. 6 is a schematic view, on an enlarged scale, of a portion of FIG. 5.

FIGS. 5 and 6 illustrate a third embodiment. This embodiment has many elements in common with that of the first embodiment, and to avoid unnecessary repetition of the description, the same reference numerals have been used for similar elements but falling within the 200-series. This embodiment employs a different type of e-latch override assembly 272 for the auxiliary latch release assembly 270 and is directed more for use on a rear door 224.

The electronic door latch 238 mounts inside the rear door 224, between a rear door inner panel 242 and rear door outer panel 243, and includes a security and release mechanism 247. The security and release mechanism 247 mounts adjacent to a latch release hole 246 in the rear door inner panel 242. The security and release mechanism 247 may be a modified child security mechanism. An auxiliary latch release 244 engages the security and release mechanism 247 and may include a latch release return spring 245 that biases it toward the mechanism 247.

The auxiliary latch release assembly 270 still includes a release cable 232 in a cable sleeve 274 fixed by a sleeve mount 276, and the e-latch override assembly 272. The override assembly 272 includes a first pivot joint 280 that redirects the release cable 232 through a latch release hole 266 into a support cylinder 264. The support cylinder 264 is mounted to the body side outer panel 250 and extends through the gap 248 into the latch release hole 246. As the release cable 232 extends through the support cylinder 264, it is redirected again by a second pivot joint 288. The second end 240 of the release cable 232 then attaches to a release pin 290, which includes a latch release member 292. The latch release member 292 extends from the support cylinder 264 and engages the auxiliary latch release 244.

The operation of the auxiliary latch release assembly 270 will now be discussed. Upon pulling the release handle (not shown in FIGS. 5 and 6), the release cable 232 will pull the release pin 290 farther into the support cylinder 264. This, in turn, will cause the latch release member 292 to pull on the auxiliary latch release 244 against the bias of the latch release return spring 245, thus triggering a release of the door latch 238 as the override assembly 272 reaches its latch release position (shown by phantom lines in FIG. 6). The rear door 224 is now unlatched. Upon release of the release handle, the latch release return spring 245 will move the auxiliary latch release assembly 270 back to its closed (nominal) position (shown by solid lines in FIGS. 5 and 6). One may then open the unlatched rear door 224.

Figure 7:
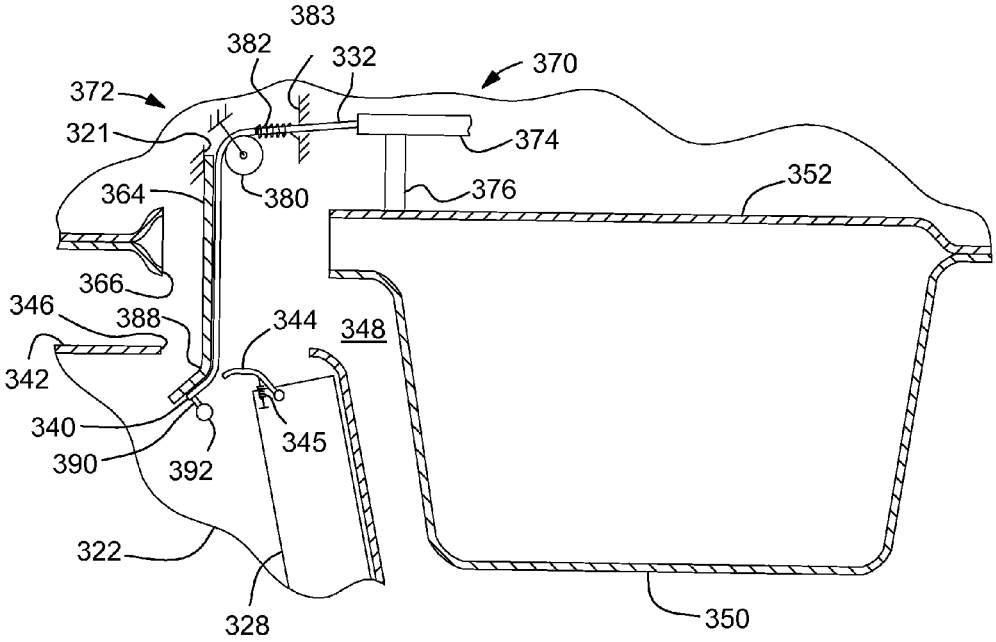
FIG. 7 is a schematic, plan view, section cut of a portion of an electronic door latch and an auxiliary latch release assembly according to a fourth embodiment.

FIG. 7 illustrates a fourth embodiment. This embodiment has many elements in common with that of the first embodiment, and to avoid unnecessary repetition of the description, the same reference numerals have been used for similar elements but falling within the 300-series. This embodiment employs a different type of e-latch override assembly 372 for the auxiliary latch release assembly 370, and a different auxiliary latch release 344.

The electronic door latch 328 mounts inside the front door 322, with a latch release hole 346 in the front door inner panel 342 adjacent to the auxiliary latch release 344. A latch release return spring 345 biases a free end of the auxiliary latch release 344 away from the latch release hole 346. The auxiliary latch release 344 is a pivoting member.

The auxiliary latch release assembly 370 still includes a release cable 332 in a cable sleeve 374 fixed by a sleeve mount 376, and the e-latch override assembly 372. The override assembly 372 includes a first pivot joint 380 that redirects the release cable 332 through a latch release hole 366 in the body side outer and inner panels 350, 352, adjacent to a fixed track 364. The fixed track 364 is fixed to the body 321 and extends through the gap 348 into the latch release hole 346. The end of the fixed track 364 includes a curved portion 388. The release cable 332 extends along the fixed track 364, with the second end 340 of the release cable 332 attached to a release pin 390. The release pin 390 can slide along the fixed track 364 and includes a latch release member 392. The latch release member 392 can engage the auxiliary latch release 344 when the release pin 390 is slid toward the curve 388 in the fixed track 364. A return spring 382 is mounted between the release cable 332 and a return spring mount 383 and biases the release pin 390 away from the auxiliary latch release 344.

The operation of the auxiliary latch release assembly 370 will now be discussed. Upon pulling the release handle (not shown in FIG. 7) against the bias of the return spring 382, the release cable 332 will cause the release pin 390 to slide along the fixed track 364. As the release pin 390 slides along the fixed track 364, the latch release member 392 catches on the auxiliary latch release 344, pivoting it against the bias of the latch release return spring 345. As the auxiliary latch release 344 pivots, it unlatches the door latch 328. Upon release of the release handle, the return spring 382 will move the auxiliary latch release assembly 170 back to its closed (nominal) position. The latch release member 392 is thus pushed back out of the way of the auxiliary latch release 344, so the door 322 can swing open and closed without anything in the door contacting the fixed track 364 or auxiliary latch release 344.

Figure 8:
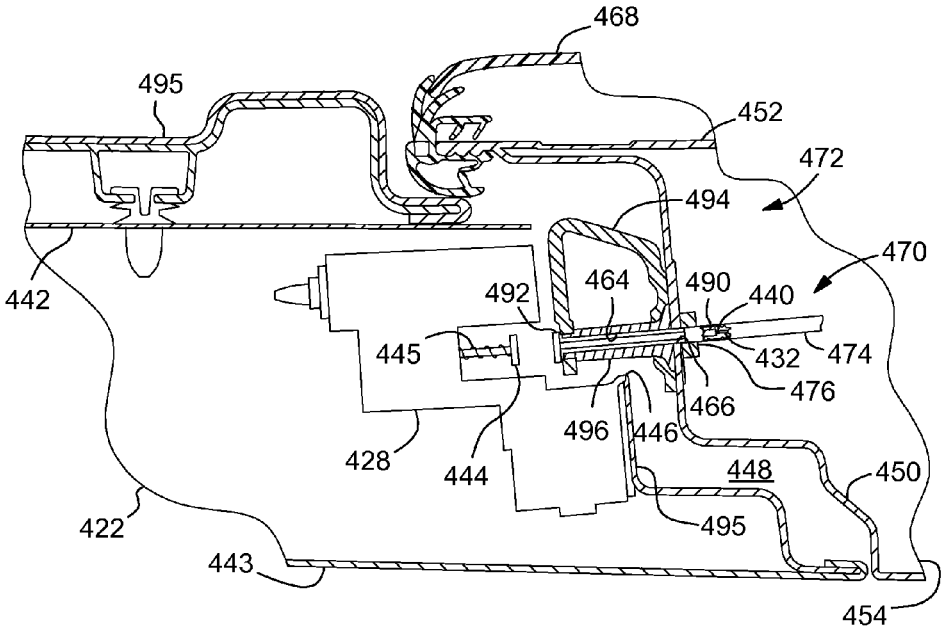
FIG. 8 is a schematic, plan view, section cut of a portion of an electronic door latch and an auxiliary latch release assembly according to a fifth embodiment.

FIG. 8 illustrates a fifth embodiment. This embodiment has many elements in common with that of the first embodiment, and to avoid unnecessary repetition of the description, the same reference numerals have been used for similar elements but falling within the 400-series. This embodiment employs a different type of e-latch override assembly 472 for the auxiliary latch release assembly 470, and a different auxiliary latch release 444.

The electronic door latch 428 mounts between the inner panel 442 and the outer panel 443 of the front door 422, with a latch release hole 446 in the inner panel 442 adjacent to the auxiliary latch release 444. A latch release return spring 445 biases a free end of the auxiliary latch release 444 toward the latch release hole 446. In this embodiment, the auxiliary latch release 444 faces a rear facing inside portion 495 adjacent to a body mounted striker assembly 494 rather than an inner portion to which a door trim panel 495 may mount.

The auxiliary latch release assembly 470 still includes a release cable 432 in a cable sleeve 474 fixed by a sleeve mount 476, and the e-latch override assembly 472. But for this embodiment, instead of routing the e-latch override assembly 472 behind interior trim 468, it may be routed in the B-pillar 454, between the body side outer and inner panels 450, 452. The override assembly 472 includes a push rod 490 connected to the second end 440 of the release cable 432. The push rod 490 extends through a latch release hole 466 that is aligned with a latch release bore 464 in a striker pin 496. The latch release bore 464 orients the push rod 490, and hence a latch release member 492, so that it aligns with the auxiliary latch release 444. Since this latch release assembly 470 uses a push rather than a pull action, the return spring (not shown in FIG.

8) may be located at the first end (not shown in FIG. 8) of the release cable 432 near or connected to the release handle (not shown in FIG. 8).

The operation of the auxiliary latch release assembly 470 will now be discussed. Upon pushing the release handle (not shown in FIG. 8), the release cable 432 will cause the push rod 490 to extend outward toward the auxiliary latch release 444 across the gap 448. As the latch release member 492 contacts the auxiliary latch release 444, the auxiliary latch release 444 will be pushed in against the bias of the latch release return spring 445, thus triggering a release of the door latch 428. Upon release of the release handle, the return spring will move the auxiliary latch release assembly 470 back to its closed (nominal) position. One may then open the unlatched front door 422.

Figure 9:
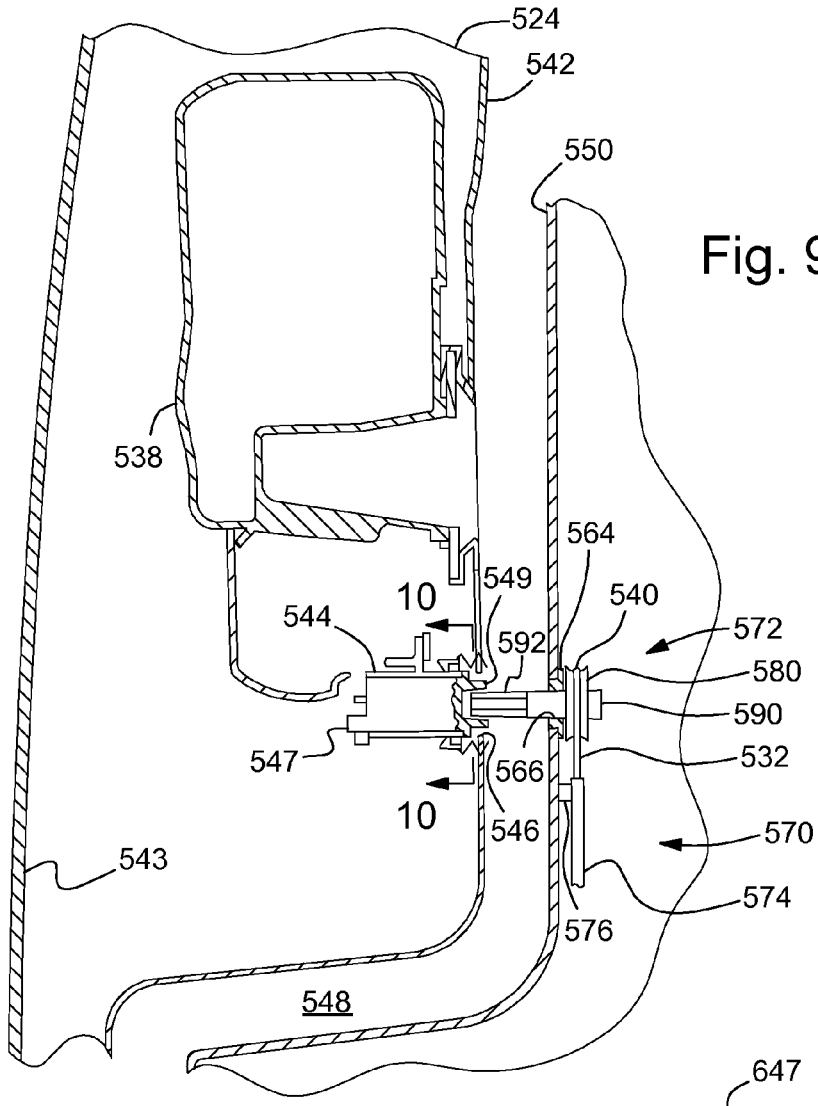
FIG. 9 is a schematic, elevation, section cut of a portion of an electronic door latch and an auxiliary latch release assembly according to a sixth embodiment.
Figure 10:
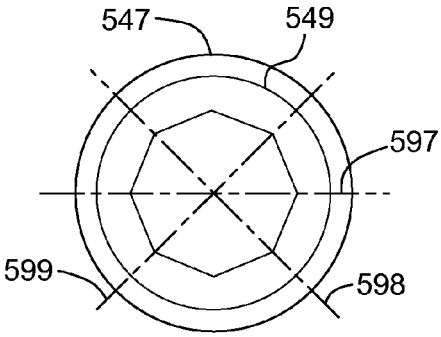
FIG. 10 is a schematic view of a front face of a release flange of a security and release mechanism, on an enlarged scale, as viewed in the direction of arrows 10-10 in FIG. 9.

FIGS. 9 and 10 illustrate a sixth embodiment. This embodiment has many elements in common with that of the first embodiment, and to avoid unnecessary repetition of the description, the same reference numerals have been used for similar elements but falling within the 500-series. This embodiment employs a different type of e-latch override assembly 572 for the auxiliary latch release assembly 570 and is directed more for use on a rear door 524 (similar to the third embodiment).

The electronic door latch 538 mounts inside the rear door 524, between a rear door inner panel 542 and a rear door outer panel 543, and includes a security and release mechanism 547. The security and release mechanism 547 mounts adjacent to a latch release hole 546 in the rear door inner panel 542. The security and release mechanism 547 may be a modified child security mechanism. The security and release mechanism 547 in this embodiment also acts as the auxiliary latch release 544 and may include a release mechanism return spring (not shown) that biases the security and release mechanism 547 toward a nominal position 597 (shown in FIG. 10) or a child security position from an auxiliary latch release position, discussed below. The nominal position 597 may be one where both an inside door handle (not shown) and an outside touch pad portion (not shown in FIGS. 9 and 10) are enabled. The security and release mechanism 547 may also include a child security position 598, which disables the inside door handle, and an auxiliary latch release position 599 that releases the door latch 538. The security and release mechanism 547 includes a release flange 549 that extends outward toward the gap 548 and is rotated to switch between the three positions 597, 598, 599. Under normal conditions, with the rear door 524 open, one may manually rotate the release flange 549 between the child security position 598 and the nominal position 597.

The auxiliary latch release assembly 570 still includes a release cable 532 in a cable sleeve 574 fixed by a sleeve mount 576, and the e-latch override assembly 572. The override assembly 572 includes a pulley 580 connected to the second end 540 of the release cable 532. A rotary shaft 590 is connected to and rotated by the pulley 580. The rotary shaft 590 extends out through a latch release hole 566 in a bearing 564 that is mounted in the body side outer panel 550, across the gap 548, and into the release flange 549. The rotary shaft 590 may include a octagonal shaped latch release member 592 that engages with the release flange 549. While the latch release member 592 and release flange 549 are shown with mating octagonal shapes, other suitable shapes that can engage to allow for rotation of the release flange 549 by the latch release member 592 may be used instead, if so desired.

The operation of the auxiliary latch release assembly 570 will now be discussed. Upon pulling the release handle (not shown in FIGS. 9 and 10), the release cable 532 will cause the pulley 580 to rotate, which will cause the rotary shaft 590 to rotate. The latch release member 592 will rotate the release flange 549—whether in the nominal position 597 or the child security position 598—to the auxiliary latch release position 599 against the bias of the latch release return spring (not shown in FIGS. 9 and 10). This rotation triggers a release of the door latch 528. Upon release of the release handle, the return spring will move the auxiliary latch release assembly 570 back to its closed (nominal) position. One may then open the unlatched rear door 524.

Figure 11:
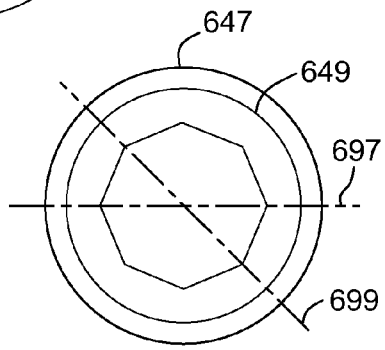
FIG. 11 is a schematic view similar to FIG. 10, but illustrating a seventh embodiment.

FIG. 11 illustrates a seventh embodiment, which is a small modification of the sixth embodiment illustrated in FIGS. 9 and 10. Since this embodiment is very similar to the sixth embodiment, and to avoid unnecessary repetition of the description, the same reference numerals have been used for similar elements but falling within the 600-series. This embodiment employs a different security and release mechanism 647 that eliminates a child security position—only having a nominal position 697 and an auxiliary latch release position 699 for releasing the door latch. The release flange 649 may be essentially the same as that used in the sixth embodiment. Also, the auxiliary latch release assembly and its operation may be the same as in the sixth embodiment.

One will note that, for all of the embodiments, the electronic door latch is mounted in the door, while the e-latch override assembly of the auxiliary latch release assembly is mounted in and remains with the vehicle body when the particular door is opened. Accordingly, even though the auxiliary latch release assembly and door latch are separated from each other when the door is open, the e-latch override assembly can be actuated to engage the auxiliary latch release when the door is closed. This allows for auxiliary release of the door latch without requiring a body mounted latch and without running a cable through a wire conduit of a door hinge.

While certain embodiments of the present invention have been described in detail, those familiar with the art to which this invention relates will recognize various alternative designs and embodiments for practicing the invention as defined by the following claims.

What is claimed is:

1. An auxiliary latch release assembly for use with a vehicle having a body with a front, a rear and a pair of sides extending from the front to the rear, the body defining a cargo area, a pivotable side door mounted on one of the sides, and a door latch mounted in the door and including an auxiliary latch release, the assembly comprising:

a handle configured to be accessible in the cargo area;

a release cable having a first end operatively engaging the handle and an opposed second end configured to extend in the body adjacent to the door having the door latch; and an e-latch override assembly configured to be mounted in the body and operatively engaging the second end of the release cable and including a latch release member actuable by the e-latch override assembly to engage the auxiliary latch release to thereby release the door latch, wherein the latch release member is configured to extend outboard from the side having the door in a lateral direction from the body to actuate the auxiliary latch release.

2. The assembly of claim 1 wherein the e-latch override assembly includes a cable attachment connected to the second end of the cable, a rigid body connected to the cable attachment and configured to be axially fixed but pivotable relative to the body, and an outboard and a laterally extending push arm pivotally connected to the rigid body and having the latch release member thereon that is configured to be outboard and laterally extendable from the body into contact with the auxiliary latch release.

3. The assembly of claim 1 wherein the e-latch override assembly includes a pulley attached to the second end of the cable, a gear rotationally coupled to the pulley, and a gear shaft having gear teeth operatively engaging the gear, and the latch release member is integral with the gear shaft.

4. The assembly of claim 1 wherein the e-latch override assembly includes a support cylinder adapted to be mounted to the body and extend outward toward the door, a release pin mounted in and extending from the support cylinder and attached to the second end of the release cable, with the release pin including the latch release member, and a pivot joint mounted to the support cylinder and operatively engaging the release cable to redirect the release cable toward the release pin.

5. The assembly of claim 1 wherein the e-latch override assembly includes a fixed track having a curved portion and being adapted to be mounted to the body and extend outward toward the door, and a release pin slidable along the fixed track and connected to the second end of the release cable, the latch release member mounted on the release pin.

6. The assembly of claim 1 wherein the e-latch override assembly includes a pulley attached to the second end of the release cable, and a rotary shaft mounted to and rotatable by the pulley and adapted to be rotatably mounted to the body and extend outward toward the door, with the rotary shaft including the latch release member.

7. The assembly of claim 1 wherein the handle is a pull handle and the cargo area is a trunk.

8. A vehicle having a body with a front, a rear and a pair of sides extending from the front to the rear, a pivotable side door mounted on one of the sides of the body and a cargo area comprising:

an electronic door latch mounted in the door and including an auxiliary latch release and an electronic latch releaser; and an auxiliary latch release assembly including a handle accessible in the cargo area, a release cable having a first end operatively engaging the handle and an opposed second end extending adjacent to the door having the electronic door latch, and an e-latch override assembly mounted in the body and operatively engaging the second end of the release cable and including a latch release member configured to extend outboard from the side having the door in a lateral direction from the body and be actuable by the e-latch override assembly to engage the auxiliary latch release to thereby release the electronic door latch.

9. The vehicle of claim 8 wherein the cargo area is a trunk.

10. The vehicle of claim 8 wherein the electronic latch releaser is an electronic touch pad.

11. The vehicle of claim 8 wherein the e-latch override assembly includes a cable attachment connected to the second end of the cable; a rigid body connected to the cable attachment and axially fixed but pivotable relative to the body; and a push arm pivotally connected to the rigid body, extending laterally outboard from the body toward the door, and having the latch release member thereon that is movable in an outboard direction to be selectively engageable with the auxiliary latch release to release the electronic door latch.

12. The vehicle of claim 8 wherein the e-latch override assembly includes a pulley that is axially fixed but rotatable relative to the body and attached to the second end of the cable; a gear rotationally coupled to the pulley; and a gear shaft having gear teeth operatively engaging the gear and extending from the body toward the door, with the latch release member being integral with the gear shaft and movable toward the auxiliary latch release when the pulley is rotated.

13. The vehicle of claim 8 wherein the e-latch override assembly includes a fixed track mounted to the body and extending outward toward the door and having a curved portion, and a release pin slidable along the fixed track and connected to the second end of the release cable, the latch release member mounted on the release pin and engageable with the auxiliary latch release when the release pin is slid toward the curved portion.

14. The vehicle of claim 8 wherein the auxiliary latch release includes a security and release mechanism mounted in the door, with the security and release mechanism selectively operable as a child security mechanism.

15. The vehicle of claim 8 wherein the auxiliary latch release assembly includes a return spring operatively engaging the e-latch override assembly to bias the latch release member away from the auxiliary latch release.

16. A method of releasing an electronic pivotable side door latch mounted in a side door of a vehicle having a body with a front, rear and a pair of sides extending from the front to the rear, with the electronic door latch including an auxiliary latch release, the method comprising the steps of:

(a) manually actuating a release cable from a cargo area of the vehicle, wherein the release cable extends in the body adjacent to the door having the electronic door latch;

(b) actuating an e-latch override assembly, mounted in the body, with the release cable;

(c) bridging a gap between the door and the body in an outboard extending lateral direction with a latch release member of the e-latch override assembly that contacts the auxiliary latch release; and (d) releasing the electronic door latch by moving the auxiliary latch release with the latch release member.

17. The method of claim 16 wherein step (c) is further defined by extending a member linearly outboard in a lateral direction from the body into contact with the auxiliary latch release.

18. The method of claim 16 wherein step (c) is further defined by rotating a member, extending outward from the body toward the door, to operatively engage the auxiliary latch release.

* * * * *